US006866146B2

(12) United States Patent
Heesch

(10) Patent No.: US 6,866,146 B2
(45) Date of Patent: Mar. 15, 2005

(54) PROTECTIVE CASE FOR STRING INSTRUMENTS

(76) Inventor: Christian M. Heesch, 1565 Wagon Wheel, Cottonwood, AZ (US) 86326

( * ) Notice: Subject to any disclaimer, the term of this patent is extended or adjusted under 35 U.S.C. 154(b) by 12 days.

(21) Appl. No.: 09/973,675

(22) Filed: Oct. 9, 2001

(65) Prior Publication Data

US 2003/0066770 A1 Apr. 10, 2003

(51) Int. Cl.[7] ..... A45C 11/00; B65D 85/30
(52) U.S. Cl. ..... 206/314
(58) Field of Search ..... 206/521, 14, 314, 206/523

(56) References Cited

U.S. PATENT DOCUMENTS 3,326,359 A * 6/1967 Katz ..... 206/14
4,151,909 A * 5/1979 Markov ..... 206/14
4,215,778 A * 8/1980 Kovins ..... 206/314
4,531,632 A * 7/1985 Weber ..... 206/14
4,846,340 A * 7/1989 Walther ..... 206/14
5,833,051 A 11/1998 Tiefenbrun et al.
6,029,804 A 2/2000 Flynn

* cited by examiner

*Primary Examiner*—Jacob K. Ackun, Jr.
(74) *Attorney, Agent, or Firm*—Garvey, Smith, Nehrbass & Doody, LLC; Charles C. Garvey, Jr.

(57) ABSTRACT

The invention provides a protective case for stringed musical instruments, comprising a base part and a top part. A plurality of soft, cushioned support members, located in the base part and the top part, holds the instrument when positioned in the closed case. The position of these support members limits the possible contact of the body of the enclosed instrument with the interior of the case to the lateral rim of the back, the ribs, and the lateral rim of the soundboard. Possible contact between the most vulnerable parts of the instrument (i.e. the center portions of the back and the soundboard) and the interior of the case is eliminated, resulting in a substantially reduced likelihood of damage to the instrument during storage and transportation. Several alternate embodiments of the invention are also disclosed.

21 Claims, 5 Drawing Sheets

PROTECTIVE CASE FOR STRING INSTRUMENTS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to protective cases for musical instruments, and, in particular, to protective cases for string instruments.

2. General Background of the Invention

String instruments such as violins, violas, and violoncellos often increase in value with age. The sound of instruments crafted by the Italian masters of the $17^{th}$ and $18^{th}$ centuries, for example, is unsurpassed by modern imitations, and instruments of that time are priceless and irreplaceable treasures, carefully guarded by those artists fortunate enough to own them. Even contemporary string instruments, hand crafted over several months in an arduous process by an ever-shrinking number of specialized artisans, generally have a high value.

Obviously, these instruments, made of thin wood at times hundreds of years of age, are quite delicate and prone to damage. Most damage to such instruments occurs during transportation. Accordingly, protective cases have always been used to prevent damage to the instrument during storage or transportation. Usually, these cases consist of a base part and a top part, connected by a hinge mechanism. A typical case features a sturdy exterior and a padded interior space, located in the base part, into which the instrument is placed. The top part of the case is then closed, and the case is locked. Unfortunately, these cases fail to reliably prevent damage to the instrument. While the padding typically used will significantly attenuate any outside forces directed against the case from a lateral direction, forces applied to the case from the front or the back will be directly transmitted to the sound board or the back of the instrument. These areas, however, are the most sensitive parts of string instruments. It is only by virtue of the slightly arched form of the sound board and the back that these structures can support the immense pressure exerted by the strings, and transmitted onto the sound board via the bridge. Any additional sudden force frequently leads to longitudinal cracks in the sound board. While such cracks can be repaired by qualified craftsmen, they may lead to a permanent reduction in the quality of sound of the instrument, and to a reduction of its value.

A variety of inventors have attempted to limit the possible damage to instruments by offering an improved design for a protective case:

U.S. Pat. No. 4,151,909 of Markov, issued May 1, 1979, describes a triangular shape for an instrument carrying case, allowing it to be stored in an erect position. While the triangular design, as the inventor points out, limits possible damage due to snow, rain, or falling objects, it does not offer improved protection against any impact affecting the sound board or the back of the instrument.

U.S. Pat. No. 4,531,632, issued to Weber on Jul. 30, 1985, offers an adjustable compartment allowing adaptation to the body length of a particular string instrument. Resilient pads selectively support the back of the instrument at its top and its bottom parts. Tie down straps secure the instrument at its neck. While this invention provides some improvement over previous designs, the resilient pads described protect the back, but not the far more delicate front portion of the instrument, which features the sound board and the bridge. Moreover, support of the back only at its top and bottom portions, with the entire middle and the side portions of the back held above the bottom of the case, may render the back quite vulnerable to the indirect transmission of applied forces, especially at its central portion. In addition, the securement of the instrument through tie down straps at its neck will not prevent the body of the instrument from colliding with the interior of the case.

U.S. Pat. No. 6,029,804 of Flynn, issued Feb. 29, 2000, describes an instrument carrying case featuring a temperature and humidity control system. While this invention will limit damage due to excesses in temperature or humidity, damage due to a sudden outside force acting upon the case will not be affected by the design.

BRIEF SUMMARY OF THE INVENTION

A new protective transport case for string instruments is suggested. In addition to the usual padded lining surrounding the ribs of the instrument, the invention features a rim of padded material adjacent to the lateral edges of the sound board, and another rim of similar padded material adjacent to the lateral edges of the back of the instrument. This arrangement of three rims of padded material securely fastens the instrument in the case.

As an additional feature, the invention proposes a securing mechanism comprising padded clamps or securing belts. These padded clamps or securing belts are attached to the interior of the base part of the case, and hold the instrument in its molded area.

There are numerous advantages of the present invention, as listed below:

1. Due to the triple rim of padded material, any force applied to the case from the outside will be transmitted to the instrument only in an attenuated form, and, moreover, will be transmitted only to the angulated area formed by the lateral edges of the soundboard, the ribs, and the lateral edges of the back of the instrument. This area is quite sturdy. The sensitive areas of the instrument, most importantly the arched middle portion of the sound board carrying the bridge, and the arched back portion of the instrument, are secured firmly and are unable to collide with any parts of the interior of the protective case.
2. The triple rim of padded material will not only prevent damage to the instrument due to sudden jolts or forces, it will also prevent damage to the instrument due to the rolling of the case upside down.
3. The padded clamps or securing belts will prevent the instrument from falling out of an unlocked case which is accidentally picked up, and they will even protect the instrument if an opened case falls to the ground.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
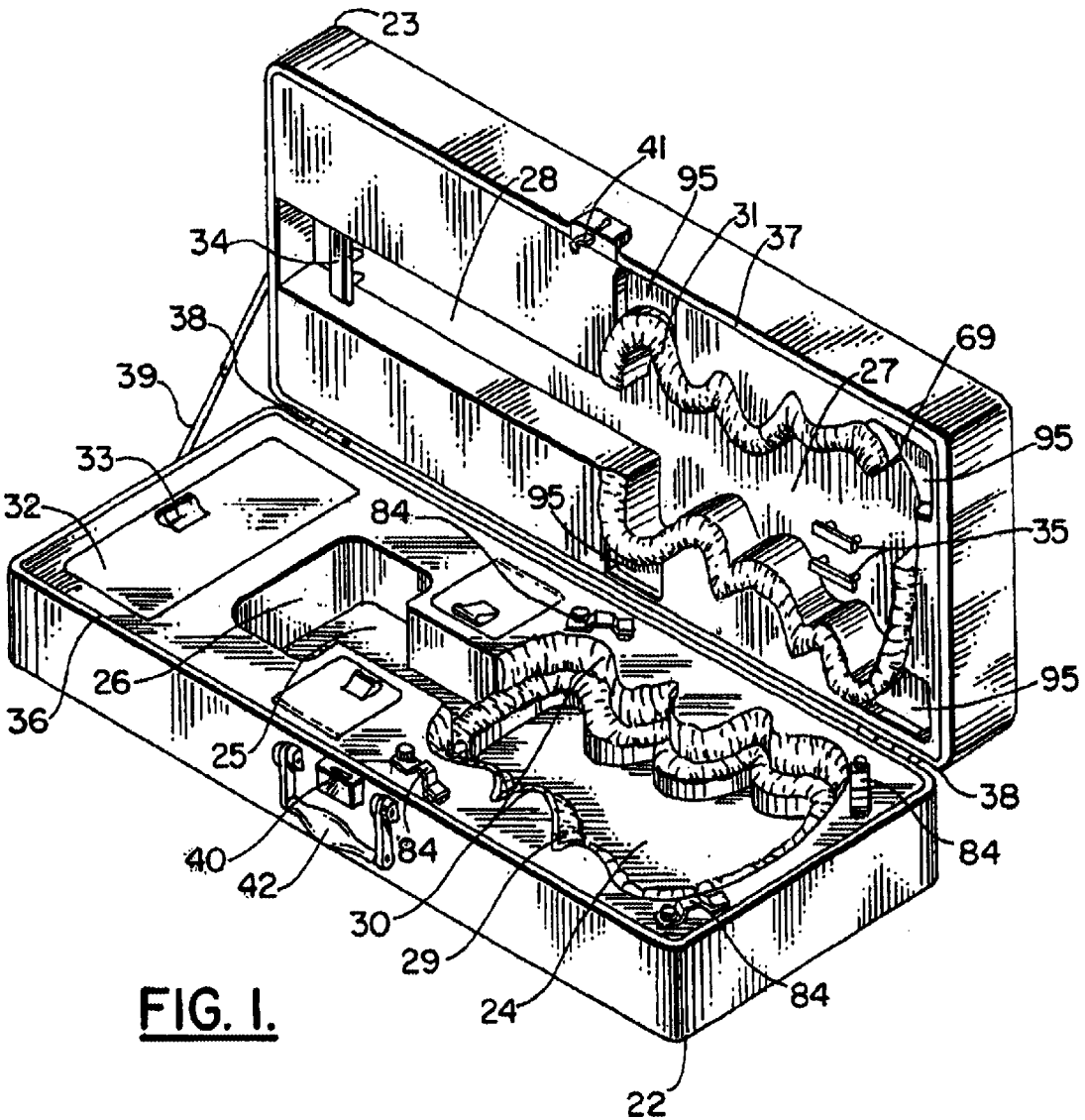
FIG. 1 is a perspective view of the present invention.

Referring now to the enclosed drawings, FIG. 1 is an overview of the present invention. The suggested protective instrument case, designated generally by the numeral 21, consists of a base part 22 and an upper part 23. The interior of base 22 provides a pre-formed space for a stringed instrument such as a violin (hereafter referred to as violin 68), divided for clarity into three sections, designated body space 24, neck space 25, and peg-box space 26, in accordance with the parts of the instrument they hold. The interior of upper part 23 provides a pre-formed space overlying the stringed instrument, divided for clarity into two sections, designated space overlying body of instrument 27, and space overlying head and neck of instrument 28.

Case 21 features three rims of cushioned, soft, elastic material (e.g. thick velvet, padded silk), labeled lower cushioned rim 29, lateral cushioned rim 30 (both located in base 22), and upper cushioned rim 31 (located in upper part 23.) Apart from the designated space for the holding of the instrument, case 21 features several compartments (not depicted in detail) for the storage of small paraphernalia, following a design customary for instrument cases. Depicted are the lids 32 overlying these compartments, as well as the tabs 33 used to open the lids. Also following a design customary for cases for stringed instruments, upper part 23 provides space and attachment facilities for the storage of a plurality of bows, including a head rest 34 for bows, as well as a plurality of customary locking bars 35 for the base area of bows.

Base part 22 and upper part 23 can be connected by hinges 38. A special recess rim 36 on base part 22, and an overlapping rim 37 on upper part 23 provide for a snug fit once case 21 is closed. A sturdy band 39 extends from the interior of base part 22 to the interior of upper part 23, and limits the angle of the opening between these parts to 90°. A customary snap lock, divided into lower lock part 40 and upper lock part 41, provides for secure closure of case 21, a customary handle 42 is used to carry the case.

Figure 2B:
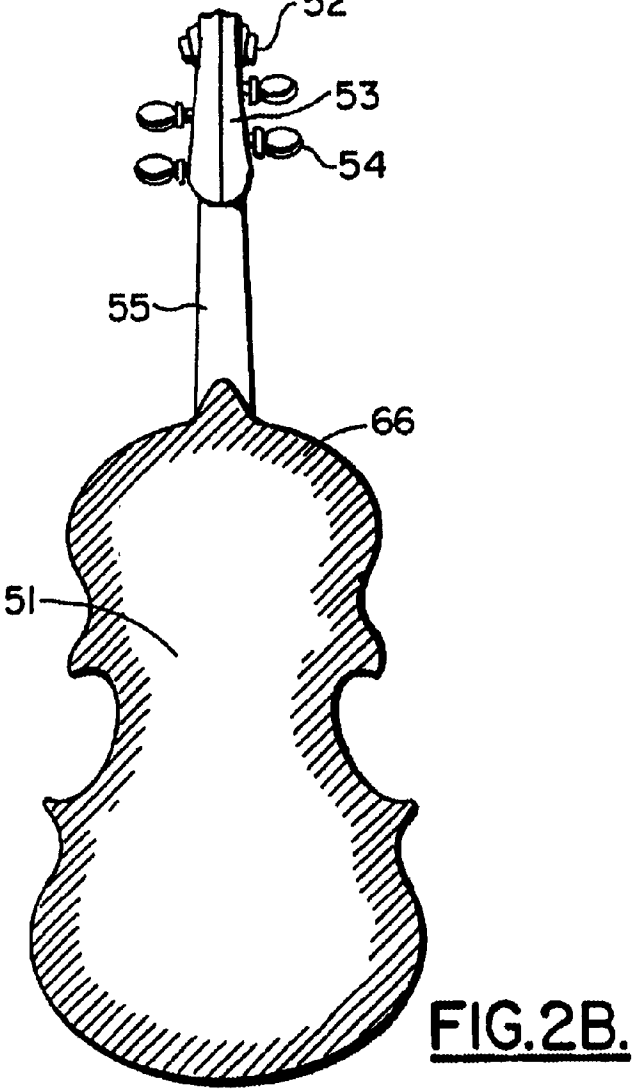
FIG. 2*b* is a plan view of the back of a string instrument, outlining parts of the instrument relevant to the present invention.
Figure 2A:
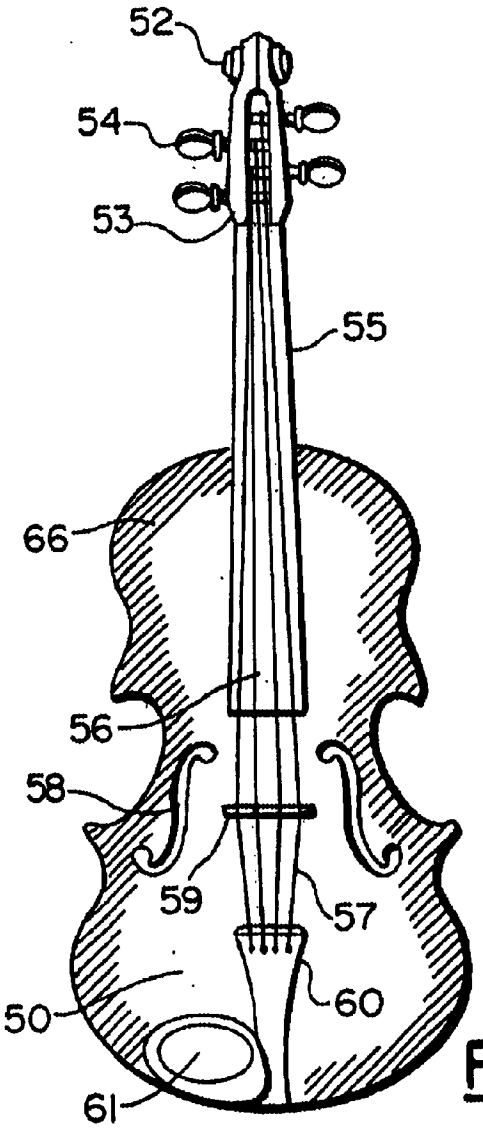
FIG. 2*a* is a plan view of the front of a string instrument, outlining parts of the instrument relevant to the present invention.

FIG. 2*a* represents the anterior surface of a violin 68, a typical string instrument to be protected by the invention. Sound board 50 features two openings, f-holes 58. Strings 57 are attached with one end to pegs 54, housed in peg box 53, extend over finger board 56, touch down on bridge 59, pressing it against sound board 50, and are then attached with their opposite ends to tail piece 60. Seen also are chin rest 61 and scroll 52, a conventional decorative element of peg box 53.

FIG. 2*b* represents the posterior surface of violin 68. Shown are the back 51, neck 55, pegs 54, and the posterior surface of peg box 53 and scroll 52.

Both FIGS. 2*a* and 2*b* show a shaded area 66, following the edges of sound board 50 and back 51. This shaded area 66 represents the area of contact between upper cushioned rim 31 and sound board 50, and between lower cushioned rim 29 and back 51, respectively.

Figure 3B:
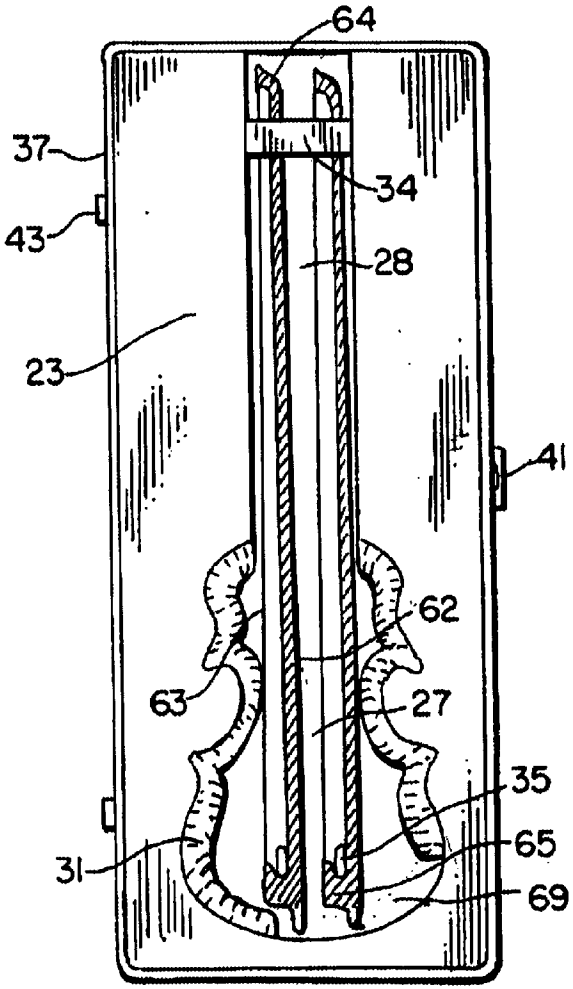
FIG. 3*b* is a plan view of the top part of the present invention.
Figure 3A:
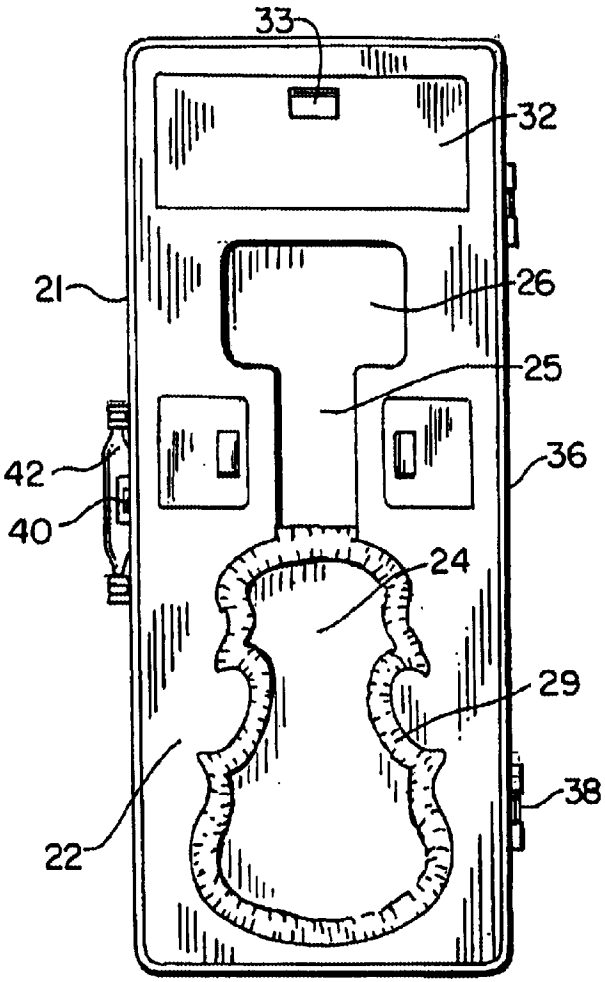
FIG. 3*a* is a plan view of the base part of the present invention.

FIG. 3*a* shows the various elements of base part 22. The area used to house the instrument is divided into body space 24, neck space 25, and peg box space 26. Lower cushioned rim 29 follows the lateral rim of body space 24. Featured are also three compartment lids 32 and corresponding lid tabs 33, as well as lower hinge parts 44, handle 42, and lower lock part 40.

FIG. 3*b* shows the various elements of upper part 23. The area overlying the instrument is divided into space 27 overlying the body of the instrument and 28 space overlying the head and neck of the instrument. At the upper end of space 28, head rest 34 for the storage of bows 62 is seen, at the lower end of space 27, two conventional locks 35, securing the frog 65 of bows 62 are shown. The conventional twisting mechanism of these locks is not depicted. Two bows 62 are shown in their stored position.

Figure 4A:
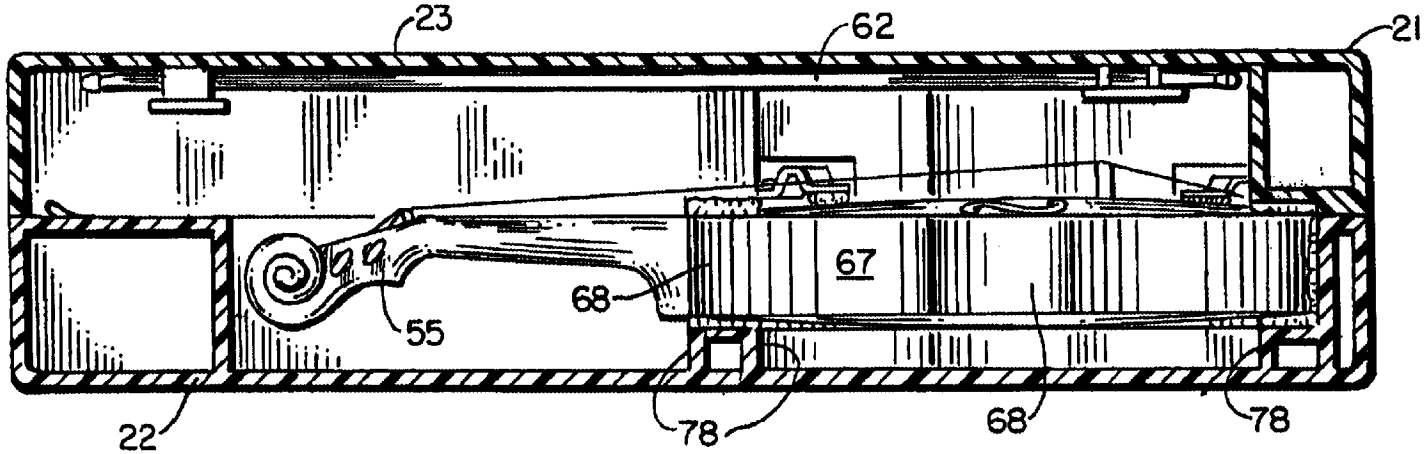
FIG. 4*a* is a longitudinal cross sectional view of the preferred embodiment of the apparatus of the present invention.
Figure 4B:
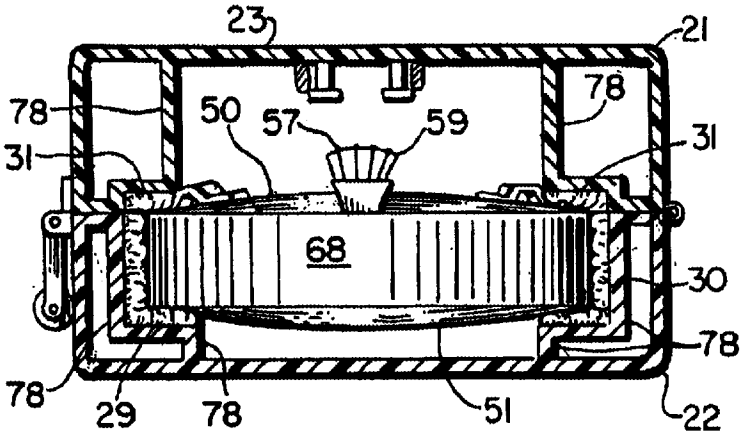
FIGS. 4*b* and 4*c* are transverse cross sectional views of the proposed protective case, also showing a string instrument in its spatial relation to the invention.
Figure 4D:
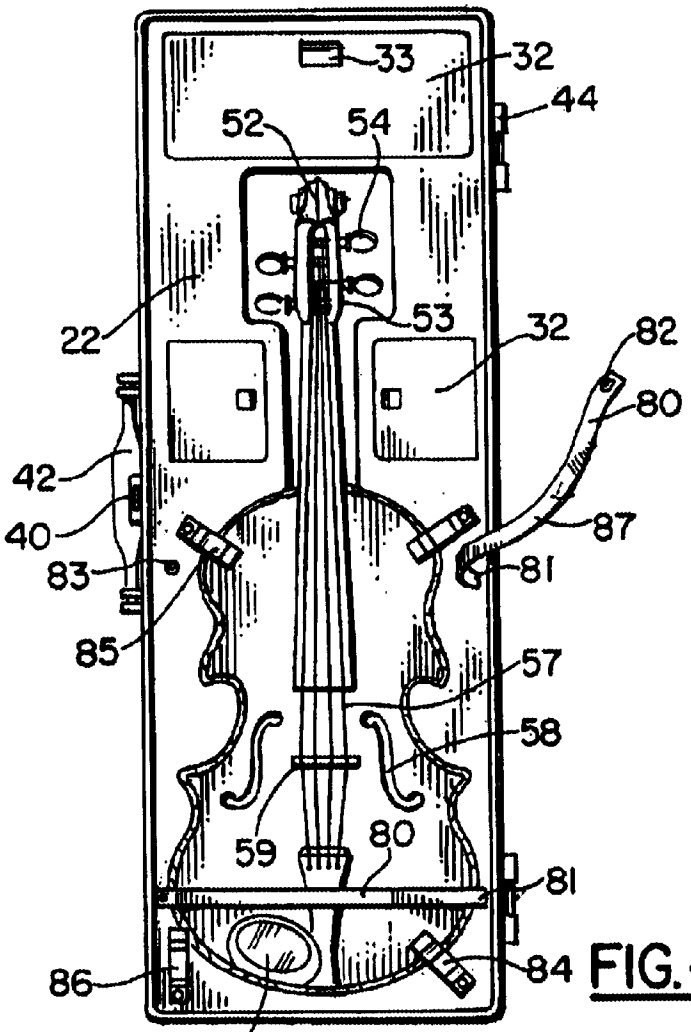
FIG. 4*d* is a plan view of the base part of the proposed protective case, also showing a string instrument in its spatial relation to the invention.
Figure 4C:
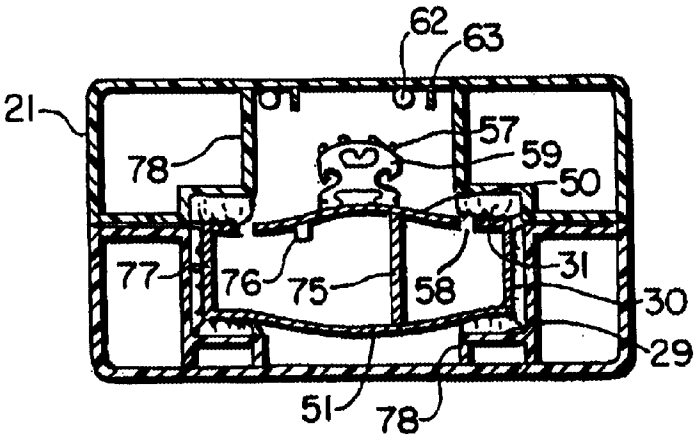

FIGS. 4*a*–4*c* are essential to appropriately illustrate the advantages of the present invention. Using cross sectional views (FIGS. 4*a*–4*c*), violin 68 is shown housed in the closed protective case 21. The view includes bridge 59, pressed by strings 57 against sound board 50. The lateral walls of the instrument, separating sound board 50 and back 51, are formed by ribs 77. The area enclosed by this structure contains sound post 75 and bass bar 76. Demonstrated are also the openings in sound board 50 due to f-holes 58.

As can clearly be seen, lower, lateral, and upper cushioned rims 29,30, and 31 secure the instrument 68 with gentle but firm attachment to ribs 77, as well as to sound board 50 and back 51 at their lateral edges (corresponding to shaded area 66 on FIGS. 2*a* and 2*b*.) The angulated lateral structure of violin 68, formed by the edges of sound board 50 and back 51, as well as ribs 77, is quite sturdy, and will withstand significant impact transmitted through cushioned rims 29,30, 31. FIGS. 4*a*–4*c* feature an internal framework 78 of case 21, as well as a cross sectional view of two bows 62 and their bow hair 63. Considering the delicately arched middle structure of sound board 50 and back 51, further weakened through the presence of f-holes 58 and the enormous pressure exerted through bridge 59 on sound board 50, it can easily be appreciated that any direct hard impact on bridge 59 or back 51 through sudden violent contact of these parts with the interior of a conventional case would prove quite disastrous to violin 68. Many an unfortunate owner of a conventional violin case can testify to that. The array of cushioned rims 29, 30, and 31, preventing instrument 60 from dislodging in any direction, and transmitting any possible sudden impact only in attenuated form, and only to sturdy parts of the instrument, will prevent such damage through anything but the most violent forms of sudden impact.

FIG. 4*d* shows the base part 22 of the present invention, with violin 68. As can be readily appreciated, the molded form of space 24 to house the body of the instrument follows the contours of the instrument, as is customary in instrument cases. Shown are several optional features of this present invention, which will provide additional protection for the instrument.

Securing belts 80 are fixed with one end to a special attachment area 81 on base part 22, and feature on their other end a conventional securing mechanism, depicted here as a male snap fastener 82, to be reversibly attached to a corresponding female snap fastener 83 on the opposing side of base part 22. Other reversible locking mechanisms could be used, including but not confined to hook and loop mechanisms, nut and bolt mechanisms, and the like. Two securing belts 80 are depicted, one in the closed 86, and one in the open position 87. Belts 80, when in the closed position, extend over sound board 50 at its upper and its lower ends. This feature will protect the instrument's most vulnerable area, the sound board 50 and bridge 59, from sudden forward thrusts against the interior of any instrument case, even if such case does not feature the suggested cushioned rims 29, 30, and 31 of this present invention.

A similar protective effect can be achieved with rotating padded clamps 84. These clamps, attached with one end rotatably to base part 22, can be turned with their padded opposite end over the lateral surface of sound board 50 of violin 68, once again preventing sudden forward movements of the instrument. Any number of rotating padded clamps 84 could be installed, shown here in their closed 85 and their open 86 positions.

While neither securing belts 80, nor rotating padded clamps 84, can provide the degree of protection afforded by cushioned rims 29, 30, and 31, they both offer significant additional advantages. First, they could be installed easily in conventional protective cases without any of the features of this present invention, and second, they would provide some degree of protection to the instrument, even if an open case were to fall to the ground upside down. They both would also prevent the instrument from falling out if an unlocked case was picked up accidentally by its handle. It is suggested that either securing belts 80, or rotating padded clamps 84, are added to instrument case 21. Without departing from the concept, a variety of other mechanisms could be used to secure violin 68 within base part 22, by applying reversible closing mechanisms attached to base part 22 which will impede the exit of violin 60 from space 24, such as shifting bars, flexible bands, and the like.

Figure 4E:
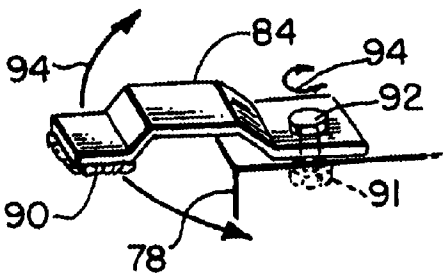
FIG. 4*e* is a partial perspective view of one particular embodiment of the invention.

FIG. 4*e* shows the details of padded clamps 84. These clamps feature padding 90 on their free end, to be rotated over violin 60, and are rotatably attached to base part 22, for example with a nut 91 and bolt 92, as depicted. Arrows 94 indicate the freedom of rotation.

If padded clamps 84 are added to the protective case, upper part 23 needs to feature a special recess area 95 for each of these clamps 84. Finally, depending on its elasticity, upper cushioned rim 31 could either be designed to mold itself around clamps 84 when protective case 21 is in the closed position, or upper cushioned rim 31 could feature small indentations allowing to receive clamps 84 when protective case 21 is closed (indentations not depicted).

Parts List

The following is a list of suitable parts and materials for the various elements of the preferred embodiment of the present invention.

Number Description

21 protective case
22 base part
23 upper part
24 body space
25 neck space
26 peg box space
27 space overlying body of instrument
28 space overlying neck and head of instrument
29 lower cushioned rim
30 lateral cushioned rim
31 upper cushioned rim
32 compartment lid
33 lid tab
34 head rest for bows
35 lock for bows
36 base part recess
37 overlapping rim
38 hinge
39 angle band
40 lower portion of lock
41 upper portion of lock
42 handle
43 upper part of hinge
44 lower part of hinge
50 sound board
51 back
52 scroll
53 peg box
54 peg
55 neck
56 finger board
57 string
58 f-hole
59 bridge
60 tail piece
61 chin rest
62 bow
63 hair of bow
64 head of bow
65 frog of bow
66 shaded support area
67 body of violin
68 violin
69 recess in upper cushioned rim
75 sound post
76 bass bar
77 ribs
78 internal frame work
80 securing belt
81 attachment area
82 male fastener
83 female fastener
84 rotating padded clamp
85 clamp in closed position
86 clamp in opened position

90 clamp padding

91 nut

92 bolt

94 arrows

95 recess area

The foregoing embodiments are presented by way of example only; the scope of the present invention is to be limited only by the following claims.

What is claimed is:

1. A portable cased stringed instrument apparatus, comprising:

a) a stringed instrument that has a neck connected to a base, the base having a sound board panel, a back panel, and lateral wall portions, the lateral wall portions being structurally connected to the sound board and back panels at joints;

b) an instrument case housing that has multiple housing sections including at least a base part and a top part connected to the base part by a mechanism that enables the opening and closing of the housing, the housing having multiple interior surfaces;

c) the base part having an interior space that is receptive of the stringed instrument, the interior surfaces including instrument engaging support surfaces that engage the stringed instrument at the joints; and d) the interior space including a void space that is positioned next to and protects the central portion of at least one of the sound board and back panels of said instrument by preventing any contact with the interior surfaces of said case.

2. The cased instrument of claim 1, wherein at least one of said interior surfaces is padded.

3. A cased stringed wooden instrument apparatus, comprising:

a) an instrument that has a body with sound board and back panels, neck, strings, a bridge and a side wall that connects peripheral portions of the sound board panel and the back panel at corner joint portions, comprising:

b) a case housing that is comprised of a pair of shells including a lower base shell and an upper cover shell, the shells being movable with respect to one another between open and closed positions;

c) a closure for holding the shells together in a closed position;

d) each of the shells having a protective liner;

e) the liners including a first liner that includes a first layer of material in the base shell that engages only the corner joint portions of the instrument back panel, the first liner spacing the center portion of the back panel away from the base shell and a second layer of material in the base shell that engages the side wall of the instrument;

f) the liners including a third layer of material that is contained in the upper cover shell that engages only a corner joint portion when in the closed position; and g) the base shell having a recess that is shaped to receive the neck.

4. The cased instrument of claim 3 wherein the base part and top part are connected together with a hinge.

5. The cased instrument of claim 3 wherein the base part and top part are connected together with a closure clasp.

6. The cased instrument of claim 3 wherein the shells are of a material selected from the group that comprises wood, metal and plastic.

7. The cased instrument of claim 3 wherein third layer of material cradles at least a part of the angulated lateral portion of the instrument.

8. The cased instrument of claim 3 further comprising a plurality of clamps that hold the instrument body into contact with the first layer of material.

9. The cased instrument of claim 3 further comprising at least one rack for supporting a stringed instrument bow.

10. The cased instrument of claim 3 wherein the third layer of material has a void space that is sized and shaped to receive the strings and bridge of the stringed instrument.

11. A cased instrument, comprising:

a) a stringed wooden instrument that has a sound board and back panels with respective peripheral portions, neck, strings, a bridge and an angulated lateral portion that connects the respective peripheral portions of the sound board and back panels, comprising:

b) a case that includes pair of shells including a lower base shell and an upper cover shell half that are movable relative to each other between open and closed positioning;

c) connections that hold the shells together in a closed position;

d) each of the shells having a protective liner;

e) the liners including a first liner that includes a first section of material in the base shell that engages only the back panel peripheral portion in the closed position and a second section of material in the base shell that engages at least a part of the angulated lateral portion of the instrument in the closed position;

f) the liners including a third section of material that is contained in the cover shell that engages only the sound board panel peripheral portion in the closed position; and g) at least one of the shell liners having a first recess that is shaped to provide a void space that receives the neck and a second recess that is shaped to provide a void space that communicates with the instrument back over a portion of its area that is spaced from the peripheral portion so that the first liner contacts only the peripheral portion of the instrument back.

12. The cased instrument of claim 11 wherein the closure includes at least one hinge.

13. The cased instrument of claim 11 wherein the closure includes at least one closure clasp.

14. The cased instrument of claim 11 wherein the shells are of a material selected from the group that comprises wood, metal and plastic.

15. The cased instrument of claim 11 wherein third layer of material engages only the peripheral portion of the sound board in the closed position and at least a portion of the angulated lateral portion.

16. The cased instrument of claim 11 further comprising a plurality of clamps that hold the instrument back into contact with at least a part of the first layer of material.

17. The cased instrument of claim 11 further comprising at least one rack for supporting a stringed instrument bow.

18. The cased instrument case of claim 11 wherein the third layer of material has a void space that is sized and shaped to receive the bridge of the stringed instrument so that no substantial load is transferred between a liner and the bridge.

19. A cased stringed instrument, comprising:

a) an instrument that has a body and a neck, the body having at least one panel joined to a peripheral wall at a peripheral joint;

b) a housing that includes a base part configured to store a stringed instrument, and a top part configured to overlay a stringed instrument stored in said base part;

c) said base part and said top part being connected by a mechanism that enables the opening and closing of said housing;

d) said base part having a first area configured to store said body of said stringed instrument, and a connected second area configured to store said neck of said stringed instrument;

e) said first area having a base and a lateral wall;

f) said base of said first area having a central portion and a peripheral portion;

g) said peripheral portion of said base of said first area of said base part having soft means; and h) said soft means being configured to elevate said body of said stringed instrument Within said protective case, so that contact of said body of said stringed instrument with said central portion of said base of said first area of said base part is prevented.

20. A cased stringed instrument apparatus:

a) a stringed instrument having a body and a neck, the body having a pair of spaced apart panels connected to a peripheral wall at joints;

b) a housing that includes a base part configured to store a stringed instrument, and a top part configured to overly a stringed instrument stored in said base part;

c) said base part and said top part being connected by a mechanism that enables the opening and closing of said housing;

d) said top part having a first area configured to overly the body of the stringed instrument stored in said base part, and an adjacent second area configured to overly the neck of a stringed instrument stored in said base part;

e) said first area of said top part having a central portion and a peripheral portion;

f) said peripheral portion of said first area of said top part having soft means; and g) said soft means being configured to engage or closely overly the body of said stringed instrument stored in said base part, so that contact of said stringed instrument with said central portion of said first area of said top part is prevented.

21. A cased stringed musical instrument apparatus, comprising:

a) a stringed instrument that has a sound board with a central portion and a peripheral portion, a back with a central portion and a peripheral portion, a neck, strings, a bridge, and a lateral curved wall that connects the sound board and the back;

b) a housing that is comprised of a pair of shells of rigid material including a lower base shell half and an upper cover shell half;

c) a plurality of links for holding the shells together, allowing for the opening and closing of said housing;

d) said lower base shell half having a recess allowing for the storage of a stringed instrument;

e) said recess having a lateral wall, and a base with a central portion and a peripheral portion;

f) said recess being configured so that the sound board and the bridge of a stored stringed instrument will face said upper cover shell half when said housing is closed;

g) a protective liner that lines parts or all of the peripheral portion of said base of said recess of said base shell half; and h) said protective liner being designed to engage all or portions of the peripheral portion of the back a stringed instrument, thereby spacing the central portion of said instrument back away from the central portion of said base of said recess.

* * * * *